US012781987B2

(12) United States Patent
Stubbs et al.

(10) Patent No.: US 12,781,987 B2
(45) Date of Patent: Nov. 3, 2026

(54) ENERGY SAVINGS FOR BUILDING MANAGEMENT SYSTEMS

(71) Applicant: Butlr Technologies, Inc., Burlingame, CA (US)

(72) Inventors: Andy Stubbs, Waltham, MA (US); Jiani Zeng, San Francisco, CA (US); Honghao Deng, Belmont, CA (US)

(73) Assignee: BUTLR TECHNOLOGIES, INC., Burlingame, CA (US)

( * ) Notice: Subject to any disclaimer, the term of this patent is extended or adjusted under 35 U.S.C. 154(b) by 330 days.

(21) Appl. No.: 18/593,355

(22) Filed: Mar. 1, 2024

(65) Prior Publication Data

US 2025/0277599 A1 Sep. 4, 2025

(51) Int. Cl.
*F24F 11/65* (2018.01)
*F24F 110/12* (2018.01)
*F24F 120/10* (2018.01)

(52) U.S. Cl.
CPC ..... *F24F 11/65* (2018.01); *F24F 2110/12* (2018.01); *F24F 2120/10* (2018.01)

(58) Field of Classification Search
CPC ..... F24F 11/65; F24F 2110/12; F24F 2120/10
See application file for complete search history.

(56) References Cited

U.S. PATENT DOCUMENTS 5,703,367 A 12/1997 Hashimoto et al.
7,570,805 B2 8/2009 Gu
8,115,641 B1 2/2012 Dempsey
8,718,748 B2 5/2014 Reinhold
9,274,204 B2 3/2016 Kim et al.
9,439,145 B2 9/2016 Van Greunen et al.
9,534,958 B1 1/2017 Lhamon et al.
9,665,776 B2 5/2017 Klehorst et al.
(Continued)

FOREIGN PATENT DOCUMENTS

AU 2014268207 6/2015
CA 2781511 12/2012
(Continued)

OTHER PUBLICATIONS

English Translation KR-102368838-B1 (Year: 2026).*
(Continued)

*Primary Examiner* — Rami Khatib
(74) *Attorney, Agent, or Firm* — SNELL & WILMER L.L.P.

(57) ABSTRACT

The system may include determining a number of occupants in a space, based on input from one or more sensors and an artificial intelligence classifier; creating a thermal model of the space based on the number of occupants, data about an outside temperature from an outside surface of one or more walls of the space, data about an inside temperature from an inside surface of one or more walls of the space and data about wall insulation for one or more walls of the space; predicting, using the thermal model, a temperature in the space for a period of time to create a predicted temperature; predicting a thermal comfort using a predicted mean vote (PMV) model and based on the predicted temperature; creating adjustment instructions for a building management system (BMS) based on the thermal comfort; and sending the adjustment instructions to the BMS.

19 Claims, 1 Drawing Sheet

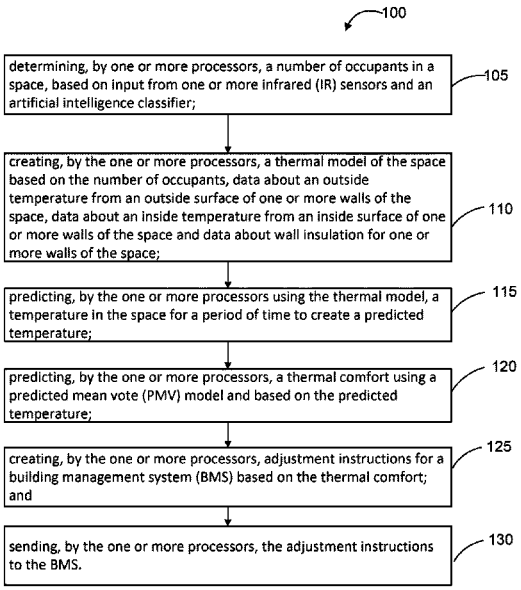

(56) References Cited

U.S. PATENT DOCUMENTS

| | | | | |
|---|---|---|---|---|
| 9,860,677 | B1 | 1/2018 | Agerstam et al. | |
| 10,019,962 | B2 | 7/2018 | Liu et al. | |
| 10,127,342 | B2 | 11/2018 | Xin et al. | |
| 10,171,891 | B1 | 1/2019 | Stamatakis | |
| 10,680,899 | B1 | 6/2020 | Ibarra | |
| 11,022,495 | B1 | 6/2021 | Deng et al. | |
| 11,080,891 | B2 | 8/2021 | Kim et al. | |
| 11,252,329 | B1 | 2/2022 | Cier et al. | |
| 11,644,363 | B2 | 5/2023 | Deng et al. | |
| 2001/0006367 | A1 | 7/2001 | Oda | |
| 2004/0254472 | A1 | 12/2004 | McQuilkin | |
| 2006/0034232 | A1 | 2/2006 | Mclaughlin et al. | |
| 2008/0253386 | A1 | 10/2008 | Barum | |
| 2011/0019560 | A1 | 1/2011 | Karaoguz et al. | |
| 2012/0150788 | A1* | 6/2012 | Berg-Sonne | G05B 15/02 706/48 |
| 2012/0253201 | A1 | 10/2012 | Reinhold | |
| 2012/0263357 | A1 | 10/2012 | Xu et al. | |
| 2014/0005810 | A1 | 1/2014 | Frei et al. | |
| 2014/0039690 | A1* | 2/2014 | Steinberg | H04Q 9/00 700/276 |
| 2015/0097680 | A1 | 4/2015 | Fadell et al. | |
| 2015/0164391 | A1 | 6/2015 | Hernandez-Rosas et al. | |
| 2015/0316419 | A1 | 11/2015 | Punnakkal | |
| 2015/0324656 | A1 | 11/2015 | Marks et al. | |
| 2015/0334315 | A1 | 11/2015 | Teich et al. | |
| 2016/0011053 | A1 | 1/2016 | Katz | |
| 2016/0021040 | A1 | 1/2016 | Frei et al. | |
| 2016/0054021 | A1* | 2/2016 | Lee | F24F 11/523 700/276 |
| 2016/0195856 | A1 | 7/2016 | Spero | |
| 2016/0217326 | A1 | 7/2016 | Hosoi | |
| 2016/0246268 | A1* | 8/2016 | ElBsat | G06F 17/16 |
| 2017/0053169 | A1 | 2/2017 | Cuban et al. | |
| 2017/0153032 | A1* | 6/2017 | Ashgriz | F24F 11/46 |
| 2017/0159953 | A1* | 6/2017 | Kim | F24F 11/30 |
| 2017/0172473 | A1 | 6/2017 | Wedekind et al. | |
| 2017/0303177 | A1 | 10/2017 | Ngounou | |
| 2017/0350946 | A1 | 12/2017 | Mukaitani et al. | |
| 2018/0100662 | A1* | 4/2018 | Farahmand | G05B 19/0428 |
| 2018/0150903 | A1 | 5/2018 | Waldron et al. | |
| 2018/0195752 | A1* | 7/2018 | Sasaki | F24F 11/64 |
| 2019/0104056 | A1 | 4/2019 | Poorrezaei et al. | |
| 2019/0332901 | A1 | 10/2019 | Doumbouya et al. | |
| 2020/0048604 | A1 | 2/2020 | Goldman et al. | |
| 2020/0074175 | A1 | 3/2020 | Zheng et al. | |
| 2020/0074373 | A1 | 3/2020 | Adato et al. | |
| 2020/0077892 | A1 | 3/2020 | Tran | |
| 2020/0175330 | A1 | 6/2020 | Wang et al. | |
| 2020/0252233 | A1 | 8/2020 | O'Keeffe | |
| 2020/0334574 | A1* | 10/2020 | Ishida | H04L 43/06 |
| 2020/0355387 | A1* | 11/2020 | Samuni | G05B 23/0254 |
| 2021/0049887 | A1 | 2/2021 | Hanson et al. | |
| 2021/0095882 | A1* | 4/2021 | Wu | F24F 3/14 |
| 2021/0174149 | A1 | 6/2021 | Zhou et al. | |
| 2021/0190355 | A1* | 6/2021 | Tokudi | F24F 11/62 |
| 2021/0207839 | A1* | 7/2021 | Drees | F24F 11/63 |
| 2021/0254851 | A1* | 8/2021 | Taguchi | G05B 13/0265 |
| 2021/0278279 | A1 | 9/2021 | Honghao et al. | |
| 2021/0279967 | A1 | 9/2021 | Gernoth et al. | |
| 2021/0398659 | A1 | 12/2021 | Sharma et al. | |
| 2022/0044441 | A1 | 2/2022 | Kalra et al. | |
| 2022/0057270 | A1 | 2/2022 | Deng et al. | |
| 2023/0103173 | A1* | 3/2023 | Androulakis | G06N 3/09 701/36 |
| 2023/0228435 | A1* | 7/2023 | Bier | F24F 11/63 700/276 |
| 2023/0243541 | A1* | 8/2023 | Stesco | G05B 15/02 700/276 |
| 2023/0349580 | A1* | 11/2023 | Brown | G06Q 10/20 |
| 2024/0110717 | A1* | 4/2024 | Zhang | F24F 11/64 |
| 2025/0130304 | A1* | 4/2025 | Koga | G06T 7/73 |
| 2025/0347435 | A1* | 11/2025 | Hata | F24F 11/63 |
| 2026/0104291 | A1* | 4/2026 | Ebrahimi | G01J 5/0025 |

FOREIGN PATENT DOCUMENTS

| | | | | |
|---|---|---|---|---|
| CN | 102184020 | A | 9/2011 | |
| CN | 102262438 | | 11/2011 | |
| CN | 102541256 | A | 7/2012 | |
| CN | 205299832 | | 6/2016 | |
| CN | 105793904 | | 7/2016 | |
| CN | 107358166 | | 11/2017 | |
| CN | 209197910 | | 8/2019 | |
| CN | 110726476 | | 1/2020 | |
| CN | 112651291 | A | 4/2021 | |
| CN | 115580912 | | 1/2023 | |
| EP | 716402 | | 6/1996 | |
| EP | 1027816 | | 8/2004 | |
| JP | H08161292 | | 6/1996 | |
| JP | 2007292651 | | 11/2007 | |
| JP | 2015231517 | | 12/2015 | |
| JP | 6117836 | | 4/2017 | |
| JP | 2017190967 | | 10/2017 | |
| JP | 2019158756 | | 9/2019 | |
| JP | 2020123239 | | 8/2020 | |
| KR | 102368838 | B1 * | 3/2022 | G06Q 50/10 |
| WO | 2002033558 | | 4/2002 | |
| WO | 03088672 | | 10/2003 | |
| WO | 2015061532 | | 4/2015 | |
| WO | 2016008430 | | 1/2016 | |
| WO | 2018056894 | | 3/2018 | |
| WO | 2021178145 | | 9/2021 | |

OTHER PUBLICATIONS

USPTO; Non-Final Office Action dated Feb. 6, 2025 in U.S. Appl. No. 18/366,916.

USPTO; Notice of Allowance dated Jun. 12, 2024 in U.S. Appl. No. 17/708,493.

CNIPA, Rejection Decision dated Jun. 7, 2024 in Application No. 202180031907.2.

CIPO, Exam Report dated Jun. 6, 2024 in Application No. 3170582.

UKIPO, United Kingdom Intent to Grant dated May 16, 2024 in Application No. 22128250.

CIPO, Examination Report dated Feb. 14, 2025 in Application No. 3170582.

ISA; International Preliminary Report on Patentability dated Jan. 28, 2022 in PCT/US2021/018661.

ISA; International Search Report and Written Opinion dated Jun. 8, 2021 in PCT/US2021/018661.

USPTO, Notice of Allowance dated Apr. 15, 2021 in U.S. Appl. No. 17/178,784.

USPTO, Notice of Allowance dated Feb. 7, 2022 in U.S. Appl. No. 17/516,954.

GB; Examination Report under Section 18(3), dated Oct. 26, 2022, in Application No. GB2212825.0.

USPTO, Non-Final Office Action, dated Nov. 21, 2022, 2023 in U.S. Appl. No. 17/232,551.

USPTO, Notice of Allowance dated Jan. 27, 2023 in U.S. Appl. No. 17/232,551.

CIPO, Examination Report dated Dec. 9, 2022 in Canadian Application No. 3,170,582.

CIPO, Combined Office Action and Examination Search Report dated Feb. 10, 2023 Application No. 3,170,582.

JPIPO, Notice of Allowance dated May 6, 2023 Application No. 2022-552886.

AUIPO, Notice of Acceptance dated Nov. 9, 2022 Applicaton No. 2021231676.

AUIPO, Notice of Acceptance dated Jan. 24, 2023 Application No. 2022275481.

USPTO, Supplemental Notice of Allowance dated Feb. 6, 2023 in U.S. Appl. No. 17/232,551.

USPTO, Non-Final Office Action dated Mar. 15, 2023 in U.S. Appl. No. 17/711,953.

USPTO, Notice of Allowance dated May 22, 2023 in U.S. Appl. No. 17/711,953.

CNIPA, First Office Action dated May 9, 2023 in Application No. 202180031907.2.

(56) References Cited

OTHER PUBLICATIONS

ISA; International Search Report and Written Opinion dated Jun. 2, 2023 in PCT/US23/13980.
AUIPO, First Office Action dated May 12, 2023 Application No. 2023202347.
AUIPO, Notice of Grant dated May 18, 2023 Application No. 2022275481.
AUIPO, Notice of Acceptance dated Jul. 3, 2023 Application No. 2023202347.
CIPO, Exam Report dated Aug. 31, 2023 in Application No. 3170582.
UKIPO, United Kingdom Exam Report dated Aug. 22, 2023 in Application No. 22128250.
CNIPA, Second Office Action dated Oct. 12, 2023 in Application No. 202180031907.2.
USPTO, Non-Final Office Action dated Oct. 25, 2023 in U.S. Appl. No. 18/194,880.
UKIPO, United Kingdom Exam Report dated Nov. 9, 2023 in Application No. 22128250.
USPTO; Notice of Allowance dated Dec. 15, 2023 in U.S. Appl. No. 18/194,880.
USPTO; Supplemental Notice of Allowance dated Dec. 27, 2023 in U.S. Appl. No. 18/194,880.
CIPO, Exam Report dated Feb. 8, 2024 in Application No. 3170582.
CNIPA, Second Office Action dated Feb. 8, 2024 in Application No. 202180031907.2.
Berry, Park, "A Passive System for Quantifying Indoor Space Utilization", ACADIA 2017, Disiplines + Disruption, pp. 138-145.
Chen et al., "A fall detection system based on infrared array sensors with tracking capability for the elderly at home", 2015 17th International Conference on E-health Networking, Application & Services, (HealthCom), Department of Electrical Engineering, National Tsing Hua University, Apr. 19, 2015, pp. 428-434, Hsinchu, Taiwan.
Chen et al., "Unobtrusive Sensor based Occupancy Facing Direction Detection and Tracking using Advanced Machine Learning Algorithms", IEEE Sensors Journal, Aug. 1, 1 2018, pp. 1-9, vol. 18, Issue: 15.
Hao, "Multiple Human Tracking and Identification With Wireless Distributed Pyroelectric Sensors", 2006, Dissertation submitted—Department of Electrical and Computer Engineering—Duke University, pp. 1-184.
Honghao Deng, et al., U.S. Appl. No. 17/178,784, filed Feb. 18, 2021 entitled "Monitoring Human Location, Trajectory and Behavior Using Thermal Data," 62 pages.
Honghao Deng, et al., U.S. Appl. No. 17/232,551, filed Apr. 16, 2021 entitled "Thermal Data Analysis for Determining Location, Trajectory and Behavior," 50 pages.
Kallur, "Human localization and activity recognition using distributed motion sensors." Diss. Oklahoma State University, 2014 (2014), entire document, especially pp. 35, 37, 40[online] <https://shareok.Org/bitstream/handle/11244/14924/Kallur_okstate_0664M_13505.pdf?sequence=1>.
Mikkilineni et al., "A novel occupancy detection solution using low-power IR-FPA based wireless occupancy sensor", Mar. 11, 2019, pp. 1-37, Energy and Buildings, Elsevier.
Shetty et al. "Detection and tracking of a human using the infrared thermopile array sensor—"Grid-EYE"", 2017 International Conference on Intelligent Computing, Instrumentation and Control Technologies, ICICICT, 2017, pp. 1490-1495.
Yuan et al., "Human indoor location for binary infrared sensor tracking system: On improved credit and dynamic pruning algorithm", ISA Transactions, Apr. 19, 2019, pp. 1-9, Published by Elsevier Ltd on behalf of ISA.
Yun et al., "Detecting direction of movement using pyroelectric infrared sensors", IEEE Sensors Journal, May 2014, pp. 1482-1489, vol. 14, No. 5.
Espejel-Blanco, et al., "HVAC Control System Using Predicted Mean Vote Index for Energy Savings in Buildings", Buildings 2022, 12, 38, 26 pages, https://doi.org/10.3390/buildings12010038.
Dyvia, et al., "Analysis of thermal comfort with predicted mean vote (PMV) index using artificial neural network", 2021 IOP Conf. Ser.: Earth Environ. Sci. 622 012019, 13 pages, doi:10.1088/1755-1315/622/1/012019.
AUIPO, Notice of Acceptance dated May 27, 2025 in Application No. 2023248184.
CAPA, Examination Report dated Jul. 22, 2025 in Application No. 3,247,080.
European Patent Office, Supplementary Search Report dated Jun. 11, 2025 in Application No. 23776825.4.
Kawashima, et al., "Action recognition from extremely low-resolution thermal image sequence", 2017 IEEE Conf. on AVSS, Aug. 29, 2017, 6 pages, doi: 10.1109/AVSS.2017.8078497.
Chen, et al., "Multi-Person Pose Estimation Using Thermal Images", IEEE Access, Sep. 19, 2020, 8 pages, doi: 10.1109/ACCESS.2020.3025413.
CAPA, Examination Report dated Oct. 15, 2025 in Application No. 3,247,080.
AUIPO, Examination Report dated Aug. 13, 2024 in Application No. 2023248184.
AUIPO, Third Examination Report dated Apr. 16, 2025 in Application No. 2023248184.
CNIPA, First Office Action dated Mar. 1, 2025 in Application No. 2023800436357.
CIPO, Notice of Allowance dated Mar. 12, 2025 in Application No. 3170582.
CNIPA, Notification of Granting a Patent Right dated Apr. 8, 2025 in Application No. 2023800436357.
JPO; Notice of Reasons for Rejection dated Feb. 19, 2025 in Japanese Application No. 2024557683.
JPO; Decision to Grant a Patent dated Apr. 1, 2025 in Japanese Application No. 2024557683.
USPTO; Notice of Allowance dated May 28, 2025 in U.S. Appl. No. 18/366,916.
USPTO; Non-Final Office Action dated Mar. 5, 2024 in U.S. Appl. No. 17/708,493.
IPEA; International Preliminary Report on Patentability dated Mar. 5, 2024 in PCT/US2023/013980.
JPO; Decision to Grant a Patent dated Jul. 2, 2024 in Japanese Application No. 2023066316.
UKIPO, United Kingdom Intent to Grant dated Jul. 24, 2024 in Application No. 22128250.
ISA; International Search Report and Written Opinion dated Oct. 10, 2024 in PCT/US2024/039406.
AUIPO, Second Examination Report dated Nov. 27, 2024 in Application No. 2023248184.
CIPO, Notice of Allowance dated Mar. 7, 2026 in Application No. 3,247,080.
ISA; International Preliminary Report on Patentability dated Feb. 6, 2026 in PCT/US2024/039406.

* cited by examiner

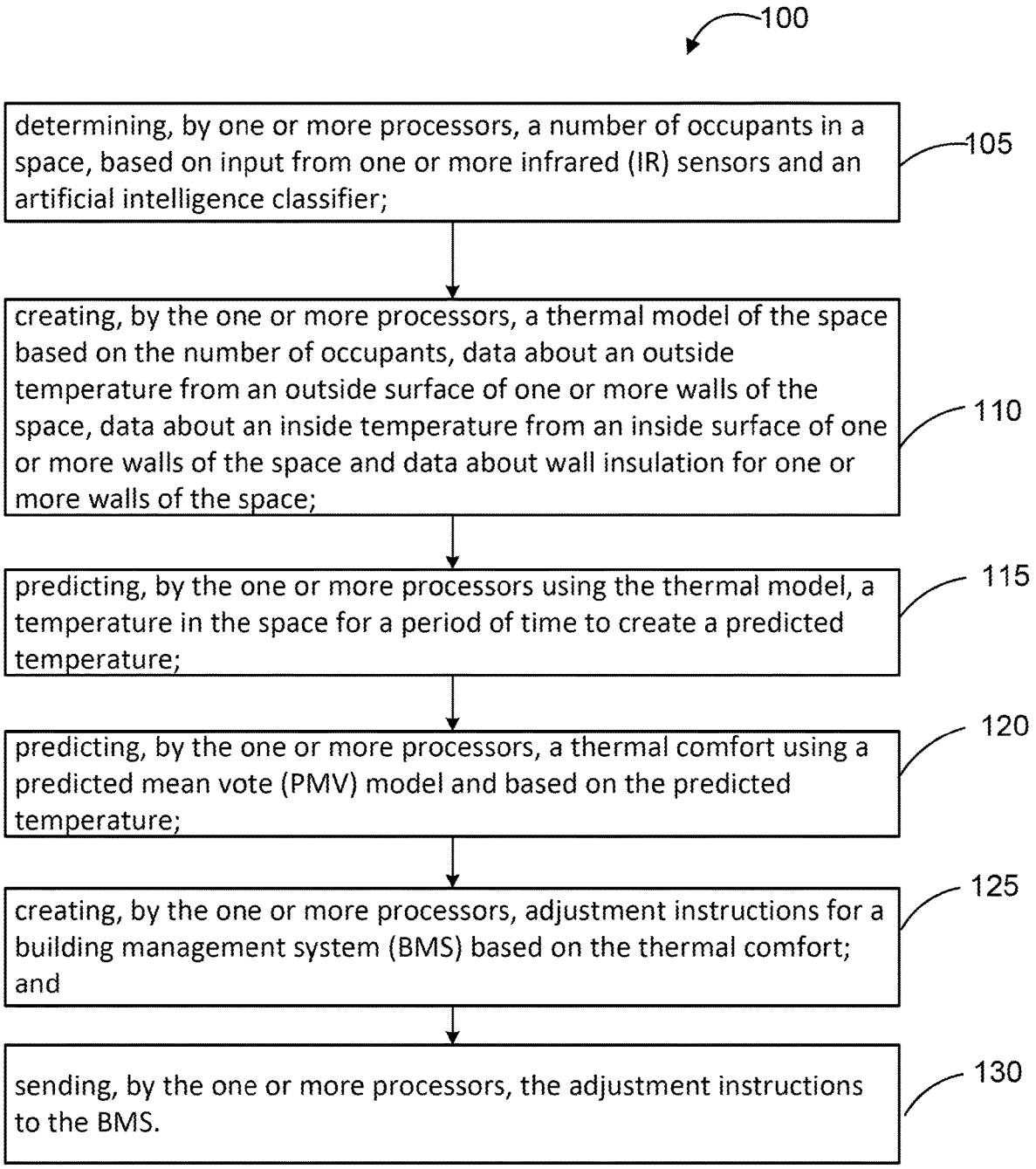
100
determining, by one or more processors, a number of occupants in a space, based on input from one or more infrared (IR) sensors and an artificial intelligence classifier;
105
creating, by the one or more processors, a thermal model of the space based on the number of occupants, data about an outside temperature from an outside surface of one or more walls of the space, data about an inside temperature from an inside surface of one or more walls of the space and data about wall insulation for one or more walls of the space;
110
predicting, by the one or more processors using the thermal model, a temperature in the space for a period of time to create a predicted temperature;
115
predicting, by the one or more processors, a thermal comfort using a predicted mean vote (PMV) model and based on the predicted temperature;
120
creating, by the one or more processors, adjustment instructions for a building management system (BMS) based on the thermal comfort; and
125
sending, by the one or more processors, the adjustment instructions to the BMS.
130

ENERGY SAVINGS FOR BUILDING MANAGEMENT SYSTEMS

FIELD

This disclosure generally relates to energy savings for building management systems, and more particularly, to more efficiently managing an HVAC system by directly obtaining the temperature of the occupants and the surfaces within a space of the building to determine occupant locations, occupant densities and/or predicting future occupancy.

BACKGROUND

Building Management Systems (BMS) are typically used in commercial structures. These BMS systems often manage HVAC systems that sometimes utilize on Passive Infrared (PIR) motion sensors for occupancy detection. While PIR sensors may be effective at detecting the presence of occupants within a space, the PIR sensors usually fail to provide specific information about the exact location of occupants within the space or the number of occupants present in the space. Consequently, HVAC systems typically operate on an all-or-nothing basis. In particular, the HVAC systems may turn on or off for an entire space with a fixed ventilation volume, regardless of the location of the occupants in the space or the number of occupants in the space. As such, a strong need exists in the HVAC industry to develop more advanced detection technologies capable of more accurately determining occupant locations and densities for more efficiently controlling the HVAC systems. Moreover, a strong need exists to predict future occupancy for more efficiently controlling the HVAC systems.

SUMMARY

In various embodiments, the system may include, for example, determining a number of occupants in a space, based on input from one or more sensors and an artificial intelligence classifier (step 105); creating a thermal model of the space based on the number of occupants, data about an outside temperature from an outside surface of one or more walls of the space, data about an inside temperature from an inside surface of one or more walls of the space and data about wall insulation for one or more walls of the space (step 110); predicting, using the thermal model, a temperature in the space for a period of time to create a predicted temperature (step 115); predicting a thermal comfort using a predicted mean vote (PMV) model and based on the predicted temperature (step 120); creating adjustment instructions for a building management system (BMS) based on the thermal comfort (step 125); and sending the adjustment instructions to the BMS (step 130).

The system may further include determining a location of the occupants in the space, based on input from the one or more infrared (IR) sensors and the artificial intelligence classifier. The one or more infrared (IR) sensors may be integrated into physical touch points in the space. The system may further include changing, by the one or more processors, the adjustment instructions based on a cost of energy during different time periods. The determining the number of occupants in the space may include (e.g., using a neural network) predicting the number of occupants in the space based on at least one of historical number of occupants during a time period or changes to the number of occupants from the historical number of occupants during a time period.

The thermal model may include a neural network. The predicting of the thermal comfort may include using a neural network for the predicting of the thermal comfort. The system may further include implementing time slicing to minimize fluctuation in the PMV index out of a comfort range. The system may further include refining the adjustment instructions to minimize fluctuation in the PMV index out of a comfort range. The system may further include creating revised adjustment instructions for the BMS to maintain the PMV index in a comfort range. The adjustment instructions may include load balancing while maintaining the PMV index within a percentage of a high end of a comfort range. The adjustment instructions may include reducing energy in the space with a lower number of occupants. The adjustment instructions may include activating a first system in the BMS that uses less energy, instead of a second system that uses more energy. The system may further include creating revised adjustment instructions for the BMS based on a profile of the occupant.

The creating the thermal model in the space may be further based on humidity in the space, occupant temperatures of occupants in the space and surface temperatures of surfaces in the space. The creating the thermal model in the space may be further based on a mean radiant temperature (MRT) in the space. The creating the thermal model in the space may be further based on a location of the occupants in the space.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figure.

FIG. 1 is a flowchart of an exemplary method, in accordance with various embodiments.

DETAILED DESCRIPTION

In various embodiments, the system monitors occupancy of a space by determining the number and/or location of the occupants in the space. The occupants may include one or more humans, one or more animals, one or more fish, one or more insects, one or more objects, and/or one or more of anything else that may emanate heat. The occupants may include building owners, landlords, property managers, tenants, visitors and/or occupants. The space may include one or more spaces comprising any area or region such as, for example, a building, a floor in a building, a room, a zone (e.g., HVAC zone), an office, a single desk, a lobby, a courtyard, an outside area, etc. The spaces may be contiguous or non-contiguous. To help monitor the occupancy, the system may use one or more sensors. The sensors may include low resolution infrared (IR) sensors (e.g., thermopile sensors) such as the Butlr Heatic 2 sensors developed by Butlr Technologies, Inc. The sensors may include multimodal devices such as, for example, IR, radar, Wi-Fi based occupancy, and/or other RF-based occupancy sensors that can detect occupancy through a means other than temperature. The second mode may add redundancy and robustness to the system. The system may also include a smart mesh between the sensors to measure the distance between the sensors.

The system may use the data from the IR sensors along with an artificial intelligence classifier to determine the number and/or location of the occupants in the space. Because the system provides data that includes a direct measurement of the temperature of the occupants and/or the temperature of the surfaces within the space, the data is much more accurate.

In various embodiments, the plurality of sensor nodes may provide information in real-time to help produce real-time location, trajectory and/or behavior analysis of human activities. The system may also gather and/or determine information about the spatial and/or temporal patterns of traffic and occupancy levels. The system may create time series detection result data, analyze occupants' moving speed based on the occupants' indoor location throughout a period of time, calculate total calories expended based on the occupants' movement, and/or monitor the occupants' body temperature. Moreover, in various embodiments, the system may measure and/or capture the temperature of the environment multiple times throughout the day in order to reduce the adverse effect of keeping a fixed background temperature field for a threshold calculation, thus increasing the accuracy of the overall detection in real world scenarios where the environmental temperature is dynamic. The system may use the post-processed detection data to create time series detection result data. The system may apply a contextual analytic algorithm to the time series detection result data to create analytics results. The system may also include real-time and historical occupant count data for the spaces that are enhanced with the sensor module. The system may further create usage reports of a space based on any of the information or data discussed herein.

To increase the accuracy of body and surface temperature readings when IR sensors are deployed at a distance from humans and objects (e.g., occupancy sensors mounted on ceilings), in various embodiments, the system may integrate IR sensors into physical touch points (e.g., switches and control panels). By using physical touch points, the system may ensure more accurate body temperature readings during occupant interactions.

For more details about detecting occupants, monitoring occupants and/or energy savings, see U.S. Pat. No. 11,022,495 issued Jun. 1, 2021 entitled "Monitoring Human Location, Trajectory And Behavior Using Thermal Data" (aka U.S. application Ser. No. 17/178,784 filed Feb. 18, 2021). U.S. Pat. No. 11,644,363 issued May 9, 2023 entitled "Thermal Data Analysis For Determining Location, Trajectory And Behavior" (aka U.S. application Ser. No. 17/232,551 filed Apr. 16, 2021). U.S. application Ser. No. 18/194,880 filed Apr. 3, 2023 entitled "Thermal Data Analysis For Determining Location, Trajectory And Behavior." U.S. Pat. No. 11,320,312 issued May 3, 2022 entitled "User Interface For Determining Location, Trajectory And Behavior" (aka U.S. application Ser. No. 17/516,954 filed Nov. 2, 2021). U.S. Pat. No. 11,774,292 issued Oct. 3, 2023 entitled "Determining An Object Based On A Fixture" (aka U.S. application Ser. No. 17/711,953 filed Apr. 1, 2022). U.S. application Ser. No. 17/708,493 filed Mar. 30, 2022 entitled "Pose Detection Using Thermal Data." U.S. application Ser. No. 18/366,916 filed Aug. 8, 2023 entitled "Energy Efficient Wireless Network Of Sensors." All of which are hereby incorporated by reference in their entireties for all purposes.

In various embodiments, the system may use environmental temperature data and/or occupancy data to increase the efficiency of the BMS. The system may provide the environmental temperature data and/or occupancy data to a BMS to control the building systems. As used herein the "building systems" may include one or more systems such as, for example, heating, cooling, window shades, awnings, window glass changes (e.g., dynamic tint), ventilation, humidifiers and/or lighting. While the system may be described as providing data or instructions to the BMS, the system also contemplates directly or indirectly providing data to one or more of the building systems. The system may also interface with smart building devices, smart phones, smart digital assistant technologies, any type of sensors and/or any type of communication devices. The system may interface with the BMS for monitoring, controlling, exchanging data and/or generating reports. The system may provide data, instructions (based on the data) or other signals to the BMS. For example, the system may integrate into the BMS by using the BMS's application programming interface (API). The BMS may be programmed with data about the cost of energy (or how to save on the costs of energy) during different times of day, during different times (e.g., seasons) of the year, etc. For example, the system and/or the BMS may include instructions that power may be less expensive during the nighttime or during certain hours.

Moreover, the system may avoid times when large energy loads are impacting the energy suppliers by having different building systems phasing in the energy usage over different times. The system may also allow a building to integrate with the electrical grid power provider and allow that electrical grid power provider to load balance a set of buildings within the comfort range (comfort band) of each of the occupants in different spaces. Because the system is able to reduce the energy load on a subset of buildings, in various embodiments, the system may allow a power company (that controls many buildings via the power grid) to rotate or adjust power between buildings to reduce the energy load on the subset of buildings, particularly the subset of buildings that have reduced energy needs using the system. Moreover, because the system reduces power to certain buildings, the buildings may not be forced to reduce power during brownouts or high-power demand times.

In various embodiments, the system may predict individual space usage and generate occupancy reports for occupants. The system may compare the occupancy reports to create predictions. The system may quickly detect a change or deviation from a repeated usage by the occupant and predict the effect of that change on the occupancy. For example, an occupant may have new team deadlines for a work project that cause the team to be in a space in the building much more often, resulting in significant occupancy increases in the space. This increased occupancy may remain the norm for three weeks. The system may detect this change in usage by using the change in occupancy and previous history, without the need to rely on scheduling calendars. However, the system may contemplate interfacing with and/or exchanging data with scheduling systems.

In various embodiments, the system may use the data about the number of occupants and/or locations of the occupants to predict the use of a space. In other words, the system may analyze past human occupancy and/or patterns in a space to establish a trend, then the system may predict (e.g., forecast) current or future occupancy and/or patterns. In particular, the system may monitor each space over a time period and determine a schedule for that space based on previous uses during that time period. The system may use predictive artificial intelligence for predictions and forecasts. For example, the system may use a neural network (e.g., a deep learning model) that incorporates the previous occupancy data to predict the occupancy patterns in the space. If the occupancy data is more random, then the neural network may provide a weighted average of the number of occupants in a space.

In various embodiments, the system may establish a thermal model of a space. The thermal model may include any type of algorithm, neural network, deep learning model, artificial intelligence and/or machine learning. The system may obtain data about the outside temperature from the outside surface of one or more the walls of the space, data about the inside temperature from the inside surfaces of one or more walls of the space and data about the wall insulation for one or more walls of the space. Directly measuring an insulation value of a wall may be overly expensive, so the system may predict the insulation value of the wall. The impact of the wall insulation may include any part of the wall such as any layers, components or materials. For example, the impact of the energy through the walls may be differently if the wall is glass, concrete, cinderblock, wood, metal, etc. As used herein, "walls" may include any surface that may have an impact on the space such as, for example, outside walls, inside walls, ceilings, windows, additional walls inside the space, temporary walls, dividers, objects in the space, furniture in the space, surfaces in the space, additional walls from other spaces that may impact the space, etc. Additional walls from other spaces may include, for example, an internal space with walls that do not abut the outside of the building. Therefore, other walls may impact the space (e.g., a wall from an adjacent space, an outside wall behind other walls, etc). Using this data, the system may then model the rate at which the energy enters the space from the outside.

The temperature in the space may be impacted by changes of the temperature in the space, changes of the temperature outside the building, changes of the temperature in an adjacent space, changes of the temperature in an area (e.g., room) above and/or changes of the temperature in an area below the space, etc. If the space has good insulation, then the changes in temperature in other areas may not as significantly impact the space. Once the thermal model is built, the system may compare the actual temperature in the space with the predicted temperature in the space from the thermal model. If the space is not actually heating as quickly as predicted, then the predicted insulation value may be too large.

In various embodiments, the system may also obtain data about the time that it takes for the temperature in a space to heat up, if there are occupants in the space. For example, if three occupants are in a space and the space is at temperature X, the HVAC may be turned off (air ventilation should keep running for health/safety reasons). The thermal model may then analyze how much time until the temperature reading in that space heats up or cools down (e.g., when the temperature gets outside of a given temperature range). The heat generated by the occupants may be due to the number of occupants in the space, the size of the occupants, if the occupants came in from the outside of the building or from a colder place (causing the occupants to absorb more heat in the space) and/or other factors. If the system determines that there is less heat generation from the occupants of the space, then the system may reduce (or turn off) the cold air conditioning to the space because the space may stay cooler for a longer period of time. However, the thermal model determines how long to reduce (or turn off) the cold air conditioning before the occupants feel uncomfortable. The predicted mean vote (PMV) model and index (discussed in more detail below) provides ways to keep the space comfortable beyond just adjusting the temperature.

In various embodiments, the system may provide instructions to adjust the BMS based on considerations of the thermal comfort (e.g., thermal sensations) of one or more of the occupants. Thermal comfort may include the occupant's satisfaction with the thermal conditions of the environment. For example, the temperature felt by the occupant may not be due to the temperature of the air, but may be impacted more by the temperature of the skin of the occupant. Thermal comfort may be impacted by sensitivity parameters such as physiological variables and environmental variables. The physiological variables may include occupants' clothing insulation, activity level and/or metabolic rate. The environmental variables may include air temperature, wind speed, relative humidity and/or radiation temperature. The thermal comfort standard may be an index of the thermal sensation known as the PMV index. The system may use an artificial neural network model to predict the thermal comfort of the PMV index with different input scenarios. The artificial neural network may be practically used to estimate the non-linear relationships between the input variables and the output variables.

In various embodiments, the system may utilize the PMV index calculated with the thermal information gathered by the sensors. For more information or functionality related to a PMV index, see H A Dyvia and C Arif 2021 Analysis of thermal comfort with predicted mean vote (PMV) index using artificial neural network. IOP Conf. Ser.: Earth Environ. Sci. 622 012019 or Daniel Fernando Espejel-Blanco, José Antonio Hoyo-Montaño, Jaime Arau, Guillermo Valencia-Palomo, Abel García-Barrientos, Héctor Ricardo Hernández-De-León and Jorge Luis Camas-Anzueto (2022), HVAC Control System Using Predicted Mean Vote Index for Energy Savings in Buildings. Buildings 2022, 12,38, which are incorporated by reference in its entirety for all purposes.

In various embodiments, the thermal model may include time slicing to avoid (or minimize) a fluctuation in the PMV index because occupants prefer that the PMV index stays within a certain comfort range (comfort band). Maintaining the PMV index within a certain comfort range may apply to one or more spaces, or one or more occupants. As such, the thermal model may determine the optimal balance between an amount of adjustment to the BMS system and its impact of the fluctuation of the PMV index. The thermal model may suggest turning off one or more of the BMS systems, but after the conditions reach the limit of the comfortable range for the PMV index for one or more of the occupants, the system turns on the BMS system again. The system may allow the conditions to reach the limit of the comfortable range for the PMV index for all impacted spaces and/or for all impacted occupants. The thermal model may also indicate that load balancing can be used to save a certain amount of energy, while the comfort level may be brought to only 50% of high end of the comfort range for the PMV index with no or little noticeable discomfort. However, if another occupant enters the space, the system may bring the comfort level to 75% of the high end of the comfort range to achieve the same energy savings. For example, three identical spaces may include 1 occupant in a first space that may not feel uncomfortable for 5 minutes after reducing the HVAC system, 2 occupants in a second space that may not feel uncomfortable for 1.5 minutes after reducing the HVAC system and 5 occupants in a third space that may feel uncomfortable immediately after reducing the HVAC system. As such, the thermal model may suggest initially reducing the energy in the spaces with less occupants (since spaces with less occupants may not feel uncomfortable for a longer period of time).

In various embodiments, the system may use the thermal model of the space to determine if load shedding and/or modulating may be used to provide a low energy (e.g., energy saving) mode for the BMS system that can be applied to one or more spaces. The BMS may be configured to provide very localized control of one or more spaces, so the adjustments may directly impact these specific spaces. Modulating may include a variable speed motor that minimizes energy use by running at the lowest possible fan speed, but still producing an optimal amount of heating or cooling to keep a steady, comfortable temperature in the space. Without modulation, the HVAC system may only operate in an "all off" mode or an "all on" mode with the motor at full capacity which uses a large amount of energy. When in an energy saving mode with load shedding, the system may reduce heating and cooling by determining which areas to turn off (or adjust) to reduce the load of the HVAC by a given percentage. For example, if the space with the occupants with the HVAC off takes 15 minutes to heat up 3 degrees, then the system may instruct the BMS to not start the heating cycle until 15 minutes after a similar number of occupants enter the space. The percentage reduction may also be set by the occupant. The percentage reduction may have the least impact on the space and/or on the area surrounding the space (e.g., the building). The system may also reduce energy by activating certain BMS systems that may be more energy efficient. For example, if the environment is hot and humid, then the system may instruct the BMS to activate the dehumidifier which uses less energy (instead of activating the cooling air conditioning that uses more energy).

In various embodiments, the system may obtain the humidity (e.g., from a humidity sensor) in the space, the relative temperatures of one or more occupants and the surface temperatures of the surroundings (e.g., furniture, surfaces, objects, etc). In particular, the system may use the temperature data including body temperatures and material surface temperatures at various locations within a space. The system may differentiate the material temperatures and the human temperatures. The PMV index considers that cold surfaces typically make the occupant feel colder than the occupant really is, even if the temperature rises. If the surfaces are cold and the occupant is warmer than the surfaces, then the PMV index may be lower because person is more comfortable around colder surfaces, so long as the overall space is still within the preferred PMV band of comfort of the occupant. If the surfaces are hotter than the occupant, then the PMV index may be outside of the comfort zone of the preferred PMV band, so the system may make the space colder or more humid.

The temperature data points allow for more accurate measurement of Mean Radiant Temperature (MRT). The mean radiant temperature (tr) may be calculated from the measured values of the dry bulb temperature (ts), the globe temperature (tg), and the relative air velocity (var) using the equation $tr=tg+1.9\cdot\sqrt{var}\cdot(tg-ts)$, wherein the dry bulb temperature is the air temperature. Globe temperature may be from a black globe thermometer. The black surface absorbs radiant heat, allowing the sensor to measure the effective temperature resulting from both convective and radiant heat transfer. The system may estimate the Globe temperature by measuring the surfaces in the room. The MRT may be used to calculate the PMV value, and the MRT is the most sensitive and strongly influencing variable for PMV. In various embodiments, the system may provide to the BMS the location data of the occupants captured by occupancy sensors, such that the BMS may adjust the dynamic BMS systems at those locations in real-time, based on individual comfort levels of the occupants. The PMV index may be calculated for each occupant, but the occupant may define a comfort range for an entire building. In various embodiments, the system may have a profile and/or identifier for each occupant, so system may customize the BMS operation for that occupant for each space that the occupant may enter. In various embodiments, the system may use the PMV index to determine how to instruct the BMS to adjust the BMS systems (e.g., temperature and humidity) to increase comfort for one or more occupants and lower HVAC expenses.

In various embodiments, the system may measure its performance by measuring the increase in the efficiency of the BMS systems (e.g., HVAC system). As previously discussed, the system may also increase efficiency by adding load shedding and modulation to the HVAC system that supplies the space. The system may directly monitor the HVAC power usage under normal usage of the system compared to the usage after the system implements its changes to the BMS systems. The actual building load reduction may depend on the PMV bands that may be set by an occupant. The system may become more efficient with the setting of wider bands because the occupant may be more comfortable for a longer period of time, before needing the BMS adjustment. For example, using a PMV index (instead of just temperature) has been shown to have an energy savings ranging from about 33% to about 44% compared to the typical built-in temperature controls of the HVAC equipment. The system directly measures the temperatures, so the system may provide added information and data to be closer to the 44% upper bound.

This system may allow the building to implement existing BMS operations by leveraging the PMV index setting. The system does not have a negative impact on the occupants because the system uses the PMV index to ensure that the occupants are comfortable. The system may allow the occupant to obtain a discount from a power provider because the system reduces energy consumption for a building, so the power provider is saving energy. The system may also prevent brown-outs by causing the buildings to be more flexible with regards to energy consumption needs (e.g., the buildings may need less energy).

The detailed description of various embodiments herein makes reference to the accompanying drawings and pictures, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not for purposes of limitation. For example, the steps recited in any of the method or process descriptions may be executed in any order and are not limited to the order presented. Moreover, any of the functions or steps may be outsourced to or performed by one or more third parties. Modifications, additions, or omissions may be made to the systems, apparatuses, and methods described herein without departing from the scope of the disclosure. For example, the components of the systems and apparatuses may be integrated or separated. An individual component may be comprised of two or more smaller components that may provide a similar functionality as the individual component. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Furthermore, any reference to singular includes plural embodiments, and any reference to more than one component may include a singular embodiment. For example, the description or claims may refer to a processor for convenience, but the invention and claim scope contemplates that the processor may be multiple processors. The multiple processors may handle separate tasks or combine to handle certain tasks. Although specific advantages have been enumerated herein, various embodiments may include some, none, or all of the enumerated advantages.

Systems, methods, and computer program products are provided. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

The system may include remote access to data, standardizing data and allowing remote users to share information in real time. The system may allow users to access data (e.g., data from the sensors) in a user interface, and receive updated data in real time from other users. The system may store the data (e.g., in a non-standardized format) in a plurality of storage devices, provide remote access over a network so that users may update the data that was in a non-standardized format (e.g., dependent on the hardware and software platform used by the user) in real time through a GUI, convert the updated data that was input (e.g., by a user) in a non-standardized form to the standardized format, automatically generate a message (e.g., containing the updated data) whenever the updated data is stored and transmit the message to the users over a computer network in real time, so that the user has immediate access to the up-to-date data. The system may allow remote users to share data in real time in a standardized format, regardless of the format (e.g., non-standardized) that the information was input by the user.

The system may include a filtering tool that is remote from the end user and provides customizable filtering features to each end user. The filtering tool may provide customizable filtering by filtering access to the data. The filtering tool may identify data, sensors, gateways, boosters, etc. that communicate with the server and may associate a request for content with the individual device. The system may include a filter on a local computer and a filter on a server. The filtering tool may identify information or accounts that communicate with the server, and associate a request for content with the individual account. The system may include a filter on a local computer and a filter on a server.

The system may store elements from different host websites (or user interfaces) in a database, then when a user accesses the database, the system may provide a hybrid webpage (or user interface) that merges content or documents from the different host websites (or user interfaces). Upon access, the system may merge the content from the various websites (or user interfaces) and provide a link to the user to access the merged data in the form of an image-based document.

The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In re Nuijten to fall outside the scope of patentable subject matter under 35 U.S.C. § 101.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments are expressly incorporated herein by reference and are intended to be encompassed by the present claims. Moreover, it is not necessary for a device or method to address each and every problem sought to be solved by the present disclosure for it to be encompassed by the present claims. Furthermore, no element, component, or method step in the present disclosure is intended to be dedicated to the public regardless of whether the element, component, or method step is explicitly recited in the claims. No claim element is intended to invoke 35 U.S.C. § 112(f) unless the element is expressly recited using the phrase "means for" or "step for". As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The process flows and screenshots depicted are merely embodiments and are not intended to limit the scope of the disclosure. For example, the steps recited in any of the method or process descriptions may be executed in any order and are not limited to the order presented. It will be appreciated that the following description makes appropriate references not only to the steps and user interface elements, but also to the various system components as described herein. It should be understood that, although exemplary embodiments are illustrated in the figures and described herein, the principles of the present disclosure may be implemented using any number of techniques, whether currently known or not. The present disclosure should in no way be limited to the exemplary implementations and techniques illustrated in the drawings and described below. Unless otherwise specifically noted, articles depicted in the drawings are not necessarily drawn to scale.

Computer programs (also referred to as computer control logic) are stored in main memory and/or secondary memory. Computer programs may also be received via communications interface. Such computer programs, when executed, enable the computer system to perform the features as discussed herein. In particular, the computer programs, when executed, enable the processor to perform the features of various embodiments. Accordingly, such computer programs represent controllers of the computer system.

These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks. These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified in the flowchart block or blocks.

In various embodiments, software may be stored in a computer program product and loaded into a computer system using a removable storage drive, hard disk drive, or communications interface. The control logic (software), when executed by the processor, causes the processor to perform the functions of various embodiments as described herein. In various embodiments, hardware components may take the form of application specific integrated circuits (ASICs). Implementation of the hardware so as to perform the functions described herein will be apparent to persons skilled in the relevant art(s).

As will be appreciated by one of ordinary skill in the art, the system may be embodied as a customization of an existing system, an add-on product, a processing apparatus executing upgraded software, a stand-alone system, a distributed system, a method, a data processing system, a device for data processing, and/or a computer program product. Accordingly, any portion of the system or a module may take the form of a processing apparatus executing code, an internet based embodiment, an entirely hardware embodiment, or an embodiment combining aspects of the internet, software, and hardware. Furthermore, the system may take the form of a computer program product on a computer-readable storage medium having computer-readable program code means embodied in the storage medium. Any suitable computer-readable storage medium may be utilized, including hard disks, CD-ROM, BLU-RAY DISC®, optical storage devices, magnetic storage devices, and/or the like.

In various embodiments, components, modules, and/or engines of system 100 may be implemented as micro-applications or micro-apps. Micro-apps are typically deployed in the context of a mobile operating system, including for example, a WINDOWS® mobile operating system, an ANDROID® operating system, an APPLE® iOS operating system, a BLACKBERRY® company's operating system, and the like. The micro-app may be configured to leverage the resources of the larger operating system and associated hardware via a set of predetermined rules which govern the operations of various operating systems and hardware resources. For example, where a micro-app desires to communicate with a device or network other than the mobile device or mobile operating system, the micro-app may leverage the communication protocol of the operating system and associated device hardware under the predetermined rules of the mobile operating system. Moreover, where the micro-app desires an input from a user, the micro-app may be configured to request a response from the operating system which monitors various hardware components and then communicates a detected input from the hardware to the micro-app.

The system and method may be described herein in terms of functional block components, screen shots, optional selections, and various processing steps. It should be appreciated that such functional blocks may be realized by any number of hardware and/or software components configured to perform the specified functions. For example, the system may employ various integrated circuit components, e.g., memory elements, processing elements, logic elements, look-up tables, and the like, which may carry out a variety of functions under the control of one or more microprocessors or other control devices. Similarly, the software elements of the system may be implemented with any programming or scripting language such as C, C++, C#, JAVA®, JAVASCRIPT®, JAVASCRIPT® Object Notation (JSON), VBScript, Macromedia COLD FUSION, COBOL, MICROSOFT® company's Active Server Pages, assembly, PERL®, PHP, awk, PYTHON®, Visual Basic, SQL Stored Procedures, PL/SQL, any UNIX® shell script, and extensible markup language (XML) with the various algorithms being implemented with any combination of data structures, objects, processes, routines or other programming elements. Further, it should be noted that the system may employ any number of techniques for data transmission, signaling, data processing, network control, and the like. Still further, the system could be used to detect or prevent security issues with a client-side scripting language, such as JAVASCRIPT®, VBScript, or the like.

The system and method are described herein with reference to screen shots, block diagrams and flowchart illustrations of methods, apparatus, and computer program products according to various embodiments. It will be understood that each functional block of the block diagrams and the flowchart illustrations, and combinations of functional blocks in the block diagrams and flowchart illustrations, respectively, can be implemented by computer program instructions.

Accordingly, functional blocks of the block diagrams and flowchart illustrations support combinations of means for performing the specified functions, combinations of steps for performing the specified functions, and program instruction means for performing the specified functions. It will also be understood that each functional block of the block diagrams and flowchart illustrations, and combinations of functional blocks in the block diagrams and flowchart illustrations, can be implemented by either special purpose hardware-based computer systems which perform the specified functions or steps, or suitable combinations of special purpose hardware and computer instructions. Further, illustrations of the process flows and the descriptions thereof may make reference to user WINDOWS® applications, webpages, websites, web forms, prompts, etc. Practitioners will appreciate that the illustrated steps described herein may comprise, in any number of configurations, including the use of WINDOWS® applications, webpages, web forms, popup WINDOWS® applications, prompts, and the like. It should be further appreciated that the multiple steps as illustrated and described may be combined into single webpages and/or WINDOWS® applications but have been expanded for the sake of simplicity. In other cases, steps illustrated and described as single process steps may be separated into multiple webpages and/or WINDOWS® applications but have been combined for simplicity.

In various embodiments, the software elements of the system may also be implemented using a JAVASCRIPT® run-time environment configured to execute JAVASCRIPT® code outside of a web browser. For example, the software elements of the system may also be implemented using NODE.JS® components. NODE.JS® programs may implement several modules to handle various core functionalities. For example, a package management module, such as NPM®, may be implemented as an open source library to aid in organizing the installation and management of third-party NODE.JS® programs. NODE.JS® programs may also implement a process manager, such as, for example, Parallel Multithreaded Machine ("PM2"); a resource and performance monitoring tool, such as, for example, Node Application Metrics ("appmetrics"); a library module for building user interfaces, and/or any other suitable and/or desired module.

Middleware may include any hardware and/or software suitably configured to facilitate communications and/or process transactions between disparate computing systems. Middleware components may be contemplated. Middleware may be implemented through commercially available hardware and/or software, through custom hardware and/or software components, or through a combination thereof. Middleware may reside in a variety of configurations and may exist as a standalone system or may be a software component residing on the internet server. Middleware may be configured to process transactions between the various components of an application server and any number of internal or external systems for any of the purposes disclosed herein. WEBSPHERE® MQTM (formerly MQSeries) by IBM®, Inc. (Armonk, NY) is an example of a commercially available middleware product. An Enterprise Service Bus ("ESB") application is another example of middleware.

The computers discussed herein may provide a suitable website or other internet-based graphical user interface which is accessible by users. In one embodiment, MICROSOFT® company's Internet Information Services (IIS), Transaction Server (MTS) service, and an SQL SERVER® database, are used in conjunction with MICROSOFT® operating systems, WINDOWS NT® web server software, SQL SERVER® database, and MICROSOFT® Commerce Server. Additionally, components such as ACCESS® software, SQL SERVER® database, ORACLE® software, SYBASE® software, INFORMIX® software, MYSQL® software, INTERBASE® software, etc., may be used to provide an Active Data Object (ADO) compliant database management system. In one embodiment, the APACHE® web server is used in conjunction with a LINUX® operating system, a MYSQL® database, and PERL®, PHP, Ruby, and/or PYTHON® programming languages.

For the sake of brevity, data networking, application development, and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical system.

In various embodiments, the methods described herein are implemented using the various particular machines described herein. The methods described herein may be implemented using the below particular machines, and those hereinafter developed, in any suitable combination, as would be appreciated immediately by one skilled in the art. Further, as is unambiguous from this disclosure, the methods described herein may result in various transformations of certain articles.

In various embodiments, the system and various components may integrate with one or more smart digital assistant technologies. For example, exemplary smart digital assistant technologies may include the ALEXA® system developed by the AMAZON® company, the GOOGLE HOME® system developed by Alphabet, Inc., the HOMEPOD® system of the APPLE® company, and/or similar digital assistant technologies. The ALEXA® system, GOOGLE HOME® system, and HOMEPOD® system, may each provide cloud-based voice activation services that can assist with tasks, entertainment, general information, and more. All the ALEXA® devices, such as the AMAZON ECHO®, AMAZON ECHO DOT®, AMAZON TAP®, and AMAZON FIRE® TV, have access to the ALEXA® system. The ALEXA® system, GOOGLE HOME® system, and HOMEPOD® system may receive voice commands via its voice activation technology, activate other functions, control smart devices, and/or gather information. For example, the smart digital assistant technologies may be used to interact with music, emails, texts, phone calls, question answering, home improvement information, smart home communication/activation, games, shopping, making to-do lists, setting alarms, streaming podcasts, playing audiobooks, and providing weather, traffic, and other real time information, such as news. The ALEXA®, GOOGLE HOME®, and HOMEPOD® systems may also allow the user to access information about eligible transaction accounts linked to an online account across all digital assistant-enabled devices.

The various system components discussed herein may include one or more of the following: a host server or other computing systems including a processor for processing digital data; a memory coupled to the processor for storing digital data; an input digitizer coupled to the processor for inputting digital data; an application program stored in the memory and accessible by the processor for directing processing of digital data by the processor; a display device coupled to the processor and memory for displaying information derived from digital data processed by the processor; and a plurality of databases. Various databases used herein may include: client data; merchant data; financial institution data; and/or like data useful in the operation of the system. As those skilled in the art will appreciate, user computer may include an operating system (e.g., WINDOWS®, UNIX®, LINUX®, SOLARIS®, MACOS® etc.) as well as various support software and drivers typically associated with computers.

The present system or any part(s) or function(s) thereof may be implemented using hardware, software, or a combination thereof and may be implemented in one or more computer systems or other processing systems. However, the manipulations performed by embodiments may be referred to in terms, such as matching or selecting, which are commonly associated with mental operations performed by a human operator. No such capability of a human operator is necessary, or desirable, in most cases, in any of the operations described herein. Rather, the operations may be machine operations or any of the operations may be conducted or enhanced by artificial intelligence (AI) or machine learning. AI may refer generally to the study of agents (e.g., machines, computer-based systems, etc.) that perceive the world around them, form plans, and make decisions to achieve their goals. Foundations of AI include mathematics, logic, philosophy, probability, linguistics, neuroscience, and decision theory. Many fields fall under the umbrella of AI, such as computer vision, robotics, machine learning, and natural language processing. Useful machines for performing the various embodiments include general purpose digital computers or similar devices. The AI or ML may store data in a decision tree in a novel way.

In various embodiments, the embodiments are directed toward one or more computer systems capable of carrying out the functionalities described herein. The computer system includes one or more processors. The processor is connected to a communication infrastructure (e.g., a communications bus, cross-over bar, network, etc.). Various software embodiments are described in terms of this exemplary computer system. After reading this description, it will become apparent to a person skilled in the relevant art(s) how to implement various embodiments using other computer systems and/or architectures. The computer system can include a display interface that forwards graphics, text, and other data from the communication infrastructure (or from a frame buffer not shown) for display on a display unit.

The computer system also includes a main memory, such as random access memory (RAM), and may also include a secondary memory. The secondary memory may include, for example, a hard disk drive, a solid-state drive, and/or a removable storage drive. The removable storage drive reads from and/or writes to a removable storage unit. As will be appreciated, the removable storage unit includes a computer usable storage medium having stored therein computer software and/or data.

In various embodiments, secondary memory may include other similar devices for allowing computer programs or other instructions to be loaded into a computer system. Such devices may include, for example, a removable storage unit and an interface. Examples of such may include a program cartridge and cartridge interface (such as that found in video game devices), a removable memory chip (such as an erasable programmable read only memory (EPROM), programmable read only memory (PROM)) and associated socket, or other removable storage units and interfaces, which allow software and data to be transferred from the removable storage unit to a computer system.

The terms "computer program medium," "computer usable medium," and "computer readable medium" are used to generally refer to media such as removable storage drive and a hard disk installed in hard disk drive. These computer program products provide software to a computer system.

The computer system may also include a communications interface. A communications interface allows software and data to be transferred between the computer system and external devices. Examples of such a communications interface may include a modem, a network interface (such as an Ethernet card), a communications port, etc. Software and data transferred via the communications interface are in the form of signals which may be electronic, electromagnetic, optical, or other signals capable of being received by communications interface. These signals are provided to communications interface via a communications path (e.g., channel). This channel carries signals and may be implemented using wire, cable, fiber optics, a telephone line, a cellular link, a radio frequency (RF) link, wireless and other communications channels.

As used herein an "identifier" may be any suitable identifier that uniquely identifies an item. For example, the identifier may be a globally unique identifier ("GUID"). The GUID may be an identifier created and/or implemented under the universally unique identifier standard. Moreover, the GUID may be stored as 128-bit value that can be displayed as 32 hexadecimal digits. The identifier may also include a major number, and a minor number. The major number and minor number may each be 16-bit integers.

In various embodiments, the server may include application servers (e.g., WEBSPHERE®, WEBLOGIC®, JBOSS®, POSTGRES PLUS ADVANCED SERVER®, etc.). In various embodiments, the server may include web servers (e.g., Apache, IIS, GOOGLE® Web Server, SUN JAVA® System Web Server, JAVA® Virtual Machine running on LINUX® or WINDOWS® operating systems).

A web client includes any device or software which communicates via any network, such as, for example any device or software discussed herein. The web client may include internet browsing software installed within a computing unit or system to conduct online transactions and/or communications. These computing units or systems may take the form of a computer or set of computers, although other types of computing units or systems may be used, including personal computers, laptops, notebooks, tablets, smart phones, cellular phones, personal digital assistants, servers, pooled servers, mainframe computers, distributed computing clusters, kiosks, terminals, point of sale (POS) devices or terminals, televisions, or any other device capable of receiving data over a network. The web client may include an operating system (e.g., WINDOWS®, WINDOWS MOBILE® operating systems, UNIX® operating system, LINUX® operating systems, APPLE® OS® operating systems, etc.) as well as various support software and drivers typically associated with computers. The web-client may also run MICROSOFT® INTERNET EXPLORER® software, MOZILLA® FIREFOX® software, GOOGLE CHROME™ software, APPLE® SAFARI® software, or any other of the myriad software packages available for browsing the internet.

As those skilled in the art will appreciate, the web client may or may not be in direct contact with the server (e.g., application server, web server, etc., as discussed herein). For example, the web client may access the services of the server through another server and/or hardware component, which may have a direct or indirect connection to an internet server. For example, the web client may communicate with the server via a load balancer. In various embodiments, web client access is through a network or the internet through a commercially-available web-browser software package. In that regard, the web client may be in a home or business environment with access to the network or the internet. The web client may implement security protocols such as Secure Sockets Layer (SSL) and Transport Layer Security (TLS). A web client may implement several application layer protocols including HTTP, HTTPS, FTP, and SFTP.

The various system components may be independently, separately, or collectively suitably coupled to the network via data links which includes, for example, a connection to an Internet Service Provider (ISP) over the local loop as is typically used in connection with standard modem communication, cable modem, DISH NETWORK®, ISDN, Digital Subscriber Line (DSL), or various wireless communication methods. It is noted that the network may be implemented as other types of networks, such as an interactive television (ITV) network. Moreover, the system contemplates the use, sale, or distribution of any goods, services, or information over any network having similar functionality described herein.

The system contemplates uses in association with web services, utility computing, pervasive and individualized computing, security and identity solutions, autonomic computing, cloud computing, commodity computing, mobility and wireless solutions, open source, biometrics, grid computing, and/or mesh computing.

Any of the communications, inputs, storage, databases or displays discussed herein may be facilitated through a website having web pages. The term "web page" as it is used herein is not meant to limit the type of documents and applications that might be used to interact with the user. For example, a typical website might include, in addition to standard HTML documents, various forms, JAVA® applets, JAVASCRIPT® programs, active server pages (ASP), common gateway interface scripts (CGI), extensible markup language (XML), dynamic HTML, cascading style sheets (CSS), AJAX (Asynchronous JAVASCRIPT And XML) programs, helper applications, plug-ins, and the like. A server may include a web service that receives a request from a web server, the request including a URL and an IP address (192.168.1.1). The web server retrieves the appropriate web pages and sends the data or applications for the web pages to the IP address. Web services are applications that are capable of interacting with other applications over a communications means, such as the internet. Web services are typically based on standards or protocols such as XML, SOAP, AJAX, WSDL and UDDI. For example, representational state transfer (REST), or RESTful, web services may provide one way of enabling interoperability between applications.

The computing unit of the web client may be further equipped with an internet browser connected to the internet or an intranet using standard dial-up, cable, DSL, or any other internet protocol. Transactions originating at a web client may pass through a firewall in order to prevent unauthorized access from users of other networks. Further, additional firewalls may be deployed between the varying components of CMS to further enhance security.

Encryption may be performed by way of any of the techniques now available in the art or which may become available—e.g., Twofish, RSA, El Gamal, Schorr signature, DSA, PGP, PKI, GPG (GnuPG), HPE Format-Preserving Encryption (FPE), Voltage, Triple DES, Blowfish, AES, MD5, HMAC, IDEA, RC6, and symmetric and asymmetric cryptosystems. The systems and methods may also incorporate SHA series cryptographic methods, elliptic curve cryptography (e.g., ECC, ECDH, ECDSA, etc.), and/or other post-quantum cryptography algorithms under development.

The firewall may include any hardware and/or software suitably configured to protect CMS components and/or enterprise computing resources from users of other networks. Further, a firewall may be configured to limit or restrict access to various systems and components behind the firewall for web clients connecting through a web server. Firewall may reside in varying configurations including Stateful Inspection, Proxy based, access control lists, and Packet Filtering among others. Firewall may be integrated within a web server or any other CMS components or may further reside as a separate entity. A firewall may implement network address translation ("NAT") and/or network address port translation ("NAPT"). A firewall may accommodate various tunneling protocols to facilitate secure communications, such as those used in virtual private networking. A firewall may implement a demilitarized zone ("DMZ") to facilitate communications with a public network such as the internet. A firewall may be integrated as software within an internet server or any other application server components, reside within another computing device, or take the form of a standalone hardware component.

Any databases discussed herein may include relational, hierarchical, graphical, blockchain, object-oriented structure, and/or any other database configurations. Any database may also include a flat file structure wherein data may be stored in a single file in the form of rows and columns, with no structure for indexing and no structural relationships between records. For example, a flat file structure may include a delimited text file, a CSV (comma-separated values) file, and/or any other suitable flat file structure. Common database products that may be used to implement the databases include DB2® by IBM® (Armonk, NY), various database products available from ORACLE® Corporation (Redwood Shores, CA), MICROSOFT ACCESS® or MICROSOFT SQL SERVER® by MICROSOFT® Corporation (Redmond, Washington), MYSQL® by MySQL AB (Uppsala, Sweden), MONGODB®, Redis, APACHE CASSANDRA®, HBASE® by APACHE®, MapR-DB by the MAPR® corporation, or any other suitable database product. Moreover, any database may be organized in any suitable manner, for example, as data tables or lookup tables. Each record may be a single file, a series of files, a linked series of data fields, or any other data structure.

As used herein, big data may refer to partially or fully structured, semi-structured, or unstructured data sets including millions of rows and hundreds of thousands of columns. A big data set may be compiled, for example, from a history of purchase transactions over time, from web registrations, from social media, from records of charge (ROC), from summaries of charges (SOC), from internal data, or from other suitable sources. Big data sets may be compiled without descriptive metadata such as column types, counts, percentiles, or other interpretive-aid data points.

Association of certain data may be accomplished through various data association techniques. For example, the association may be accomplished either manually or automatically. Automatic association techniques may include, for example, a database search, a database merge, GREP, AGREP, SQL, using a key field in the tables to speed searches, sequential searches through all the tables and files, sorting records in the file according to a known order to simplify lookup, and/or the like. The association step may be accomplished by a database merge function, for example, using a "key field" in pre-selected databases or data sectors. Various database tuning steps are contemplated to optimize database performance. For example, frequently used files such as indexes may be placed on separate file systems to reduce In/Out ("I/O") bottlenecks.

More particularly, a "key field" partitions the database according to the high-level class of objects defined by the key field. For example, certain types of data may be designated as a key field in a plurality of related data tables and the data tables may then be linked on the basis of the type of data in the key field. The data corresponding to the key field in each of the linked data tables is preferably the same or of the same type. However, data tables having similar, though not identical, data in the key fields may also be linked by using AGREP, for example. In accordance with various embodiments, any suitable data storage technique may be utilized to store data without a standard format. Data sets may be stored using any suitable technique, including, for example, storing individual files using an ISO/IEC 7816-4 file structure; implementing a domain whereby a dedicated file is selected that exposes one or more elementary files containing one or more data sets; using data sets stored in individual files using a hierarchical filing system; data sets stored as records in a single file (including compression, SQL accessible, hashed via one or more keys, numeric, alphabetical by first tuple, etc.); data stored as Binary Large Object (BLOB); data stored as ungrouped data elements encoded using ISO/IEC 7816-6 data elements; data stored as ungrouped data elements encoded using ISO/IEC Abstract Syntax Notation (ASN.1) as in ISO/IEC 8824 and 8825; other proprietary techniques that may include fractal compression methods, image compression methods, etc.

In various embodiments, the ability to store a wide variety of information in different formats is facilitated by storing the information as a BLOB. Thus, any binary information can be stored in a storage space associated with a data set. As discussed above, the binary information may be stored in association with the system or external to but affiliated with the system. The BLOB method may store data sets as ungrouped data elements formatted as a block of binary via a fixed memory offset using either fixed storage allocation, circular queue techniques, or best practices with respect to memory management (e.g., paged memory, least recently used, etc.). By using BLOB methods, the ability to store various data sets that have different formats facilitates the storage of data, in the database or associated with the system, by multiple and unrelated owners of the data sets. For example, a first data set which may be stored may be provided by a first party, a second data set which may be stored may be provided by an unrelated second party, and yet a third data set which may be stored may be provided by a third party unrelated to the first and second party. Each of these three exemplary data sets may contain different information that is stored using different data storage formats and/or techniques. Further, each data set may contain subsets of data that also may be distinct from other subsets.

As stated above, in various embodiments, the data can be stored without regard to a common format. However, the data set (e.g., BLOB) may be annotated in a standard manner when provided for manipulating the data in the database or system. The annotation may comprise a short header, trailer, or other appropriate indicator related to each data set that is configured to convey information useful in managing the various data sets. For example, the annotation may be called a "condition header," "header," "trailer," or "status," herein, and may comprise an indication of the status of the data set or may include an identifier correlated to a specific issuer or owner of the data. In one example, the first three bytes of each data set BLOB may be configured or configurable to indicate the status of that particular data set; e.g., LOADED, INITIALIZED, READY, BLOCKED, REMOVABLE, or DELETED. Subsequent bytes of data may be used to indicate for example, the identity of the issuer, user, transaction/membership account identifier or the like. Each of these condition annotations are further discussed herein.

The data set annotation may also be used for other types of status information as well as various other purposes. For example, the data set annotation may include security information establishing access levels. The access levels may, for example, be configured to permit only certain individuals, levels of employees, companies, or other entities to access data sets, or to permit access to specific data sets based on the transaction, merchant, issuer, user, or the like. Furthermore, the security information may restrict/permit only certain actions, such as accessing, modifying, and/or deleting data sets. In one example, the data set annotation indicates that only the data set owner or the user are permitted to delete a data set, various identified users may be permitted to access the data set for reading, and others are altogether excluded from accessing the data set. However, other access restriction parameters may also be used allowing various entities to access a data set with various permission levels as appropriate.

The data, including the header or trailer, may be received by a standalone interaction device configured to add, delete, modify, or augment the data in accordance with the header or trailer. As such, in one embodiment, the header or trailer is not stored on the transaction device along with the associated issuer-owned data, but instead the appropriate action may be taken by providing to the user, at the standalone device, the appropriate option for the action to be taken. The system may contemplate a data storage arrangement wherein the header or trailer, or header or trailer history, of the data is stored on the system, device or transaction instrument in relation to the appropriate data.

One skilled in the art will also appreciate that, for security reasons, any databases, systems, devices, servers, or other components of the system may consist of any combination thereof at a single location or at multiple locations, wherein each database or system includes any of various suitable security features, such as firewalls, access codes, encryption, decryption, compression, decompression, and/or the like.

Practitioners will also appreciate that there are a number of methods for displaying data within a browser-based document. Data may be represented as standard text or within a fixed list, scrollable list, drop-down list, editable text field, fixed text field, pop-up window, and the like. Likewise, there are a number of methods available for modifying data in a web page such as, for example, free text entry using a keyboard, selection of menu items, check boxes, option boxes, and the like.

The data may be big data that is processed by a distributed computing cluster. The distributed computing cluster may be, for example, a HADOOP® software cluster configured to process and store big data sets with some of nodes comprising a distributed storage system and some of nodes comprising a distributed processing system. In that regard, distributed computing cluster may be configured to support a HADOOP® software distributed file system (HDFS) as specified by the Apache Software Foundation at www.hadoop.apache.org/docs.

As used herein, the term "network" includes any cloud, cloud computing system, or electronic communications system or method which incorporates hardware and/or software components. Communication among the parties may be accomplished through any suitable communication channels, such as, for example, a telephone network, an extranet, an intranet, internet, point of interaction device (point of sale device, personal digital assistant (e.g., an IPHONE® device, a BLACKBERRY® device), cellular phone, kiosk, etc.), online communications, satellite communications, off-line communications, wireless communications, transponder communications, local area network (LAN), wide area network (WAN), virtual private network (VPN), networked or linked devices, keyboard, mouse, and/or any suitable communication or data input modality. Moreover, although the system is frequently described herein as being implemented with TCP/IP communications protocols, the system may also be implemented using IPX, APPLETALK® program, IP-6, NetBIOS, OSI, any tunneling protocol (e.g., IPsec, SSH, etc.), or any number of existing or future protocols. If the network is in the nature of a public network, such as the internet, it may be advantageous to presume the network to be insecure and open to eavesdroppers. Specific information related to the protocols, standards, and application software utilized in connection with the internet may be contemplated.

"Cloud" or "Cloud computing" includes a model for enabling convenient, on-demand network access to a shared pool of configurable computing resources (e.g., networks, servers, storage, applications, and services) that can be rapidly provisioned and released with minimal management effort or service provider interaction. Cloud computing may include location-independent computing, whereby shared servers provide resources, software, and data to computers and other devices on demand.

As used herein, "transmit" may include sending electronic data from one system component to another over a network connection. Additionally, as used herein, "data" may include encompassing information such as commands, queries, files, data for storage, and the like in digital or any other form.

Any database discussed herein may comprise a distributed ledger maintained by a plurality of computing devices (e.g., nodes) over a peer-to-peer network. Each computing device maintains a copy and/or partial copy of the distributed ledger and communicates with one or more other computing devices in the network to validate and write data to the distributed ledger. The distributed ledger may use features and functionality of blockchain technology, including, for example, consensus-based validation, immutability, and cryptographically chained blocks of data. The blockchain may comprise a ledger of interconnected blocks containing data. The blockchain may provide enhanced security because each block may hold individual transactions and the results of any blockchain executables. Each block may link to the previous block and may include a timestamp. Blocks may be linked because each block may include the hash of the prior block in the blockchain. The linked blocks form a chain, with only one successor block allowed to link to one other predecessor block for a single chain. Forks may be possible where divergent chains are established from a previously uniform blockchain, though typically only one of the divergent chains will be maintained as the consensus chain. In various embodiments, the blockchain may implement smart contracts that enforce data workflows in a decentralized manner. The system may also include applications deployed on user devices such as, for example, computers, tablets, smartphones, Internet of Things devices ("IoT" devices), etc. The applications may communicate with the blockchain (e.g., directly or via a blockchain node) to transmit and retrieve data. In various embodiments, a governing organization or consortium may control access to data stored on the blockchain. Registration with the managing organization(s) may enable participation in the blockchain network.

Data transfers performed through the blockchain-based system may propagate to the connected peers within the blockchain network within a duration that may be determined by the block creation time of the specific blockchain technology implemented. For example, on an ETHEREUM®-based network, a new data entry may become available within about 13-20 seconds as of the writing. On a HYPERLEDGER® Fabric 1.0 based platform, the duration is driven by the specific consensus algorithm that is chosen, and may be performed within seconds. In that respect, propagation times in the system may be improved compared to existing systems, and implementation costs and time to market may also be drastically reduced. The system also offers increased security at least partially due to the immutable nature of data that is stored in the blockchain, reducing the probability of tampering with various data inputs and outputs. Moreover, the system may also offer increased security of data by performing cryptographic processes on the data prior to storing the data on the blockchain. Therefore, by transmitting, storing, and accessing data using the system described herein, the security of the data is improved, which decreases the risk of the computer or network from being compromised.

In various embodiments, the system may also reduce database synchronization errors by providing a common data structure, thus at least partially improving the integrity of stored data. The system also offers increased reliability and fault tolerance over traditional databases (e.g., relational databases, distributed databases, etc.) as each node operates with a full copy of the stored data, thus at least partially reducing downtime due to localized network outages and hardware failures. The system may also increase the reliability of data transfers in a network environment having reliable and unreliable peers, as each node broadcasts messages to all connected peers, and, as each block comprises a link to a previous block, a node may quickly detect a missing block and propagate a request for the missing block to the other nodes in the blockchain network.

The particular blockchain implementation described herein provides improvements over technology by using a decentralized database and improved processing environments. In particular, the blockchain implementation improves computer performance by, for example, leveraging decentralized resources (e.g., lower latency). The distributed computational resources improves computer performance by, for example, reducing processing times. Furthermore, the distributed computational resources improves computer performance by improving security using, for example, cryptographic protocols.

Any communication, transmission, and/or channel discussed herein may include any system or method for delivering content (e.g., data, information, metadata, etc.), and/or the content itself. The content may be presented in any form or medium, and in various embodiments, the content may be delivered electronically and/or capable of being presented electronically. For example, a channel may comprise a website, mobile application, or device (e.g., FACEBOOK®, YOUTUBE®, PANDORA®, APPLE TV®, MICROSOFT® XBOX®, ROKU®, AMAZON FIRE®, GOOGLE CHROMECAST™, SONY® PLAYSTATION®, NINTENDO® SWITCH®, etc.) a uniform resource locator ("URL"), a document (e.g., a MICROSOFT® Word or EXCEL™, an ADOBE® Portable Document Format (PDF) document, etc.), an "ebook," an "emagazine," an application or microapplication (as described herein), an short message service (SMS) or other type of text message, an email, a FACEBOOK® message, a TWITTER® tweet, multimedia messaging services (MMS), and/or other type of communication technology. In various embodiments, a channel may be hosted or provided by a data partner. In various embodiments, the distribution channel may comprise at least one of a merchant website, a social media website, affiliate or partner websites, an external vendor, a mobile device communication, social media network, and/or location based service. Distribution channels may include at least one of a merchant website, a social media site, affiliate or partner websites, an external vendor, and a mobile device communication. Examples of social media sites include FACEBOOK®, FOURSQUARE®, TWITTER®, LINKEDIN®, INSTAGRAM®, PINTEREST®, TUMBLR®, REDDIT®, SNAPCHAT®, WHATSAPP®, FLICKR®, VK®, QZONE®, WECHAT®, and the like. Examples of affiliate or partner websites include AMERICAN EXPRESS®, GROUPON®, LIVINGSOCIAL®, and the like. Moreover, examples of mobile device communications include texting, email, and mobile applications for smartphones.

The invention claimed is:

1. A method comprising:

determining, by one or more processors, a number of occupants in a space, a location of the occupants in the space and a temperature of the occupants in the space, based on input from one or more infrared sensors and an artificial intelligence classifier, wherein the one or more infrared sensors directly measure the temperature of the occupants in the space and surface temperatures of surfaces in the space;

creating, by the one or more processors, a thermal model of the space based on the number of occupants, the location of the occupants in the space, the temperature of the occupants in the space, the surface temperatures of surfaces in the space, data about an outside temperature from an outside surface of one or more walls of the space, and data about an inside temperature from an inside surface of one or more walls of the space;

predicting, by the one or more processors using the thermal model, a temperature at the location of the occupants in the space for a period of time to create a predicted temperature;

predicting, by the one or more processors, a thermal comfort using a predicted mean vote (PMV) model and based on the predicted temperature at the location of the occupants in the space;

differentiating, by the one or more processors, material temperatures of the surfaces from human temperatures of the occupants using directly measured temperature data from the one or more infrared sensors;

estimating, by the one or more processors, a globe temperature by measuring surfaces in the space;

determining, by the one or more processors, a mean radiant temperature (MRT) based on the estimated globe temperature;

calculating, by the one or more processors, PMV thermal comfort using the MRT for at least one occupant at the location of the occupants in the space;

creating, by the one or more processors and for a building management system (BMS), adjustment instructions for dynamic BMS systems at the location of the occupants in the space in real time based on individual comfort levels and based on the PMV thermal comfort; and sending, by the one or more processors, the adjustment instructions to the BMS for adjusting the thermal comfort for the location of the occupants in the space, wherein the BMS adjusts an amount of air flow and a level of temperature of the air in the air conditioning system to achieve the adjustment of the thermal comfort for the location of the occupants in the space.

2. The method of claim 1, further comprising determining, by one or more processors, a location of the occupants in the space, based on input from the one or more infrared sensors and the artificial intelligence classifier.

3. The method of claim 1, further comprising changing, by the one or more processors, the adjustment instructions based on a cost of energy during different time periods.

4. The method of claim 1, wherein the determining the number of occupants in the space includes at least one of:

predicting the number of occupants in the space based on at least one of historical number of occupants during a time period or changes to the number of occupants from the historical number of occupants during a time period; or using a neural network for predicting the number of occupants in the space based on at least one of historical number of occupants during a time period or changes to the number of occupants from the historical number of occupants during a time period.

5. The method of claim 1, wherein the creating the thermal model and the predicting the thermal comfort include using a neural network.

6. The method of claim 1, wherein the one or more infrared sensors at least one of:

include one or more thermopile sensors are integrated into physical touch points in the space;

are multi-model sensors, wherein the multi-modal sensors include at least one of one or more radar sensors, one or more WiFi based occupancy sensors, or one or more radio frequency (RF) based occupancy sensors; or include a plurality of infrared sensors, and a smart mesh system is included between the infrared sensors of the plurality of infrared sensors, wherein the smart mesh system is configured to measure the distance between the infrared sensors.

7. The method of claim 1, further comprising implementing, by the one or more processors, time slicing to minimize fluctuation in the PMV index out of a comfort range.

8. The method of claim 1, further comprising refining, by the one or more processors, the adjustment instructions to minimize fluctuation in the PMV index out of a comfort range.

9. The method of claim 1, further comprising creating, by the one or more processors, revised adjustment instructions for the BMS to maintain the PMV index in a comfort range.

10. The method of claim 1, wherein the adjustment instructions include at least one of load balancing while maintaining the PMV index within a percentage of a high end of a comfort range, reducing energy in the space with a lower number of occupants, or activating a first system in the BMS that uses less energy, instead of a second system that uses more energy.

11. The method of claim 1, further comprising creating, by the one or more processors, revised adjustment instructions for the BMS based on a profile of the occupant.

12. The method of claim 1, wherein the creating the thermal model in the space is further based on humidity in the space, occupant temperatures of occupants in the space and surface temperatures of surfaces in the space.

13. The method of claim 1, wherein the creating the thermal model in the space is further based on a mean radiant temperature (MRT) in the space.

14. The method of claim 1, wherein the creating the thermal model in the space is further based on a location of the occupants in the space.

15. The method of claim 1, further comprising determining, by the one or more processors, at least one of:

a trajectory of the occupants in the space, wherein the creating the thermal model is further based on the trajectory of the occupants in the space;

spatial and temporal patterns of traffic of the occupants in the space, wherein the creating the thermal model is further based on the spatial and temporal patterns of traffic of the occupants in the space; or a moving speed of the occupants in the space, wherein the creating the thermal model is further based on the moving speed of the occupants in the space.

16. The method of claim 1, wherein the creating the thermal model of the space is further based on data about wall insulation for one or more walls of the space.

17. The method of claim 1, wherein at least one of:

the estimating the globe temperature comprises measuring a plurality of material surface temperatures at different locations in the space and deriving the globe temperature therefrom;

the calculating the PMV thermal comfort using the MRT is performed individually for each occupant at a respective location in the space; or the adjustment instructions are further based on an occupant profile or identifier to customize BMS operation for each occupant in each space.

18. An article of manufacture including one or more non-transitory, tangible computer readable storage mediums having instructions stored thereon that, in response to execution by one or more processors, cause the one or more processors to perform operations comprising:

determining, by the one or more processors, a number of occupants in a space, a location of the occupants in the space and a temperature of the occupants in the space, based on input from one or more infrared sensors and an artificial intelligence classifier, wherein the one or more infrared sensors directly measure the temperature of the occupants in the space and surface temperatures of surfaces in the space;

creating, by the one or more processors, a thermal model of the space based on the number of occupants, the location of the occupants in the space, the temperature of the occupants in the space, the surface temperatures of surfaces in the space, data about an outside temperature from an outside surface of one or more walls of the space, and data about an inside temperature from an inside surface of one or more walls of the space;

predicting, by the one or more processors using the thermal model, a temperature at the location of the occupants in the space for a period of time to create a predicted temperature;

predicting, by the one or more processors, a thermal comfort using a predicted mean vote (PMV) model and based on the predicted temperature at the location of the occupants in the space;

differentiating, by the one or more processors, material temperatures of the surfaces from human temperatures of the occupants using directly measured temperature data from the one or more infrared sensors;

estimating, by the one or more processors, a globe temperature by measuring surfaces in the space;

determining, by the one or more processors, a mean radiant temperature (MRT) based on the estimated globe temperature;

calculating, by the one or more processors, PMV thermal comfort using the MRT for at least one occupant at the location of the occupants in the space;

creating, by the one or more processors and for a building management system (BMS), adjustment instructions for dynamic BMS systems at the location of the occupants in the space in real time based on individual comfort levels and based on the PMV thermal comfort; and sending, by the one or more processors, the adjustment instructions to the BMS for adjusting the thermal comfort for the location of the occupants in the space, wherein the BMS adjusts an amount of air flow and a level of temperature of the air in the air conditioning system to achieve the adjustment of the thermal comfort for the location of the occupants in the space.

19. A system comprising:

one or more processors; and one or more tangible, non-transitory memories configured to communicate with the one or more processors, the one or more tangible, non-transitory memories having instructions stored thereon that, in response to execution by the one or more processors, cause the one or more processors to perform operations comprising:

determining, by the one or more processors, a number of occupants in a space, a location of the occupants in the space and a temperature of the occupants in the space, based on input from one or more infrared sensors and an artificial intelligence classifier, wherein the one or more infrared sensors directly measure the temperature of the occupants in the space and surface temperatures of surfaces in the space;

creating, by the one or more processors, a thermal model of the space based on the number of occupants, the location of the occupants in the space, the temperature of the occupants in the space, the surface temperatures of surfaces in the space, data about an outside temperature from an outside surface of one or more walls of the space, and data about an inside temperature from an inside surface of one or more walls of the space;

predicting, by the one or more processors using the thermal model, a temperature at the location of the occupants in the space for a period of time to create a predicted temperature;

predicting, by the one or more processors, a thermal comfort using a predicted mean vote (PMV) model and based on the predicted temperature at the location of the occupants in the space;

differentiating, by the one or more processors, material temperatures of the surfaces from human temperatures of the occupants using directly measured temperature data from the one or more infrared sensors;

estimating, by the one or more processors, a globe temperature by measuring surfaces in the space;

determining, by the one or more processors, a mean radiant temperature (MRT) based on the estimated globe temperature;

calculating, by the one or more processors, PMV thermal comfort using the MRT for at least one occupant at the location of the occupants in the space;

creating, by the one or more processors and for a building management system (BMS), adjustment instructions for dynamic BMS systems at the location of the occupants in the space in real time based on individual comfort levels and based on the PMV thermal comfort; and sending, by the one or more processors, the adjustment instructions to the BMS for adjusting the thermal comfort for the location of the occupants in the space, wherein the BMS adjusts an amount of air flow and a level of temperature of the air in the air conditioning system to achieve the adjustment of the thermal comfort for the location of the occupants in the space.

* * * * *